US009140039B1

(12) United States Patent
Krishnan et al.

(10) Patent No.: US 9,140,039 B1
(45) Date of Patent: Sep. 22, 2015

(54) ADJUSTABLE STRIKER FOR A VEHICLE CLOSURE

(71) Applicant: FORD GLOBAL TECHNOLOGIES, LLC, Dearborn, MI (US)

(72) Inventors: Venkatesh Krishnan, Canton, MI (US); Livianu Dorin Puscas, Rochester Hills, MI (US); Bhupendra A. Patel, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1 day.

(21) Appl. No.: 14/194,934

(22) Filed: Mar. 3, 2014

(51) Int. Cl.
*E05B 15/02* (2006.01)
*E05B 85/04* (2014.01)
*E05B 15/00* (2006.01)

(52) U.S. Cl.
CPC ..... *E05B 85/04* (2013.01); *E05B 2015/028* (2013.01); *E05B 2015/0275* (2013.01); *Y10S 292/60* (2013.01)

(58) Field of Classification Search
CPC ..... E05B 2015/0275; E05B 2015/028; Y10S 292/60
USPC ..... 292/340, 341.18, 341.19, DIG. 60
See application file for complete search history.

(56) References Cited

U.S. PATENT DOCUMENTS

| | | | | | |
|---|---|---|---|---|---|
| 394,685 | A | * | 12/1888 | Fether | 292/210 |
| 1,634,814 | A | | 12/1924 | Williams | |
| 1,614,046 | A | * | 1/1927 | Schmidgall | 292/341.18 |
| 1,869,815 | A | * | 8/1932 | Katz | 292/341.18 |
| 1,900,077 | A | * | 3/1933 | Riffle | 292/341.11 |
| 2,174,987 | A | * | 10/1939 | Lickteig | 292/341.18 |
| 2,401,854 | A | * | 6/1946 | Berry, Jr. | 292/341.19 |
| 2,731,822 | A | * | 1/1956 | Bargman | 70/135 |
| 2,886,365 | A | | 5/1959 | Fox et al. | |
| 3,179,458 | A | * | 4/1965 | Sconzo | 292/341.15 |
| 4,087,123 | A | * | 5/1978 | Redshaw | 292/341.19 |
| 4,305,611 | A | * | 12/1981 | Robins | 292/238 |
| 4,451,071 | A | * | 5/1984 | Striese et al. | 292/341.18 |
| 4,602,813 | A | * | 7/1986 | Gergoe et al. | 292/340 |
| 5,193,868 | A | * | 3/1993 | O'Toole | 292/341.15 |
| 6,783,163 | B2 | * | 8/2004 | Sadler | 292/341.18 |
| 6,814,401 | B2 | * | 11/2004 | Takada | 296/202 |
| 7,744,135 | B2 | * | 6/2010 | Wiese et al. | 292/341.15 |
| 8,272,169 | B2 | * | 9/2012 | Mahdi | 49/449 |
| 8,382,171 | B2 | * | 2/2013 | Williams | 292/341 |

(Continued)

FOREIGN PATENT DOCUMENTS

| | | | |
|---|---|---|---|
| FR | 2952604 | B1 * | 12/2011 |
| FR | 2975364 | A1 * | 11/2012 |
| JP | 5-85429 | A | 4/1993 |

OTHER PUBLICATIONS

Automotive Corner, "Automotive Adjusting Doors, etc.", www.autocorner.com/pages/adjustments.htm.

*Primary Examiner* — Carlos Lugo
(74) *Attorney, Agent, or Firm* — Raymond Coppiellie; Brooks Kushman P.C.

(57) ABSTRACT

An adjustable striker assembly for a vehicle closure. The striker assembly employs at least one threaded connector that when rotated moves a striker relative the vehicle in an axial direction of the threaded connector. A latch in combination with the striker define a gap between the closure and vehicle part proximate the two. Adjustment of the striker via the threaded connector allows for changing the distance of the gap between the closure and vehicle part.

16 Claims, 2 Drawing Sheets

(56) References Cited

U.S. PATENT DOCUMENTS 8,469,413 B2 6/2013 Novajovsky et al.
8,733,807 B2 * 5/2014 Williams ..... 292/341.15
8,752,871 B2 * 6/2014 Rechberg et al. ..... 292/340
2009/0108591 A1 * 4/2009 De Vries ..... 292/64
2012/0086224 A1 * 4/2012 Novajovsky et al. .... 292/341.18

* cited by examiner

ADJUSTABLE STRIKER FOR A VEHICLE CLOSURE

TECHNICAL FIELD

This disclosure relates to vehicle closures having a latch and striker combination to secure a closure to a vehicle when the latch engages the striker, and specifically to the adjusting of the distance between the closure and the vehicle resulting from the securing of the closure.

BACKGROUND

A vehicle closure may be opened to provide access to an area of the vehicle or closed to secure it. A vehicle closure may be called a door, decklid, hood, or top, among other things. A vehicle door is typically a type of closure that is in front of an opening which is used for entering and exiting a cabin area of the vehicle. A vehicle door may be hinged or attached by other mechanisms such as tracks, such as often used to access cargo areas of vans. A rear door for access to the cabin or a cargo area on a vehicle may be referred to as a hatch or tailgate. Traditionally the hatch is a rear door that swings upward to provide access to a cargo area of a hatchback style vehicle. Traditionally a tailgate is a rear door that is hinged at the bottom and is common on station wagons, pickup trucks, and sport utility vehicles.

A decklid, also known as a trunk lid or boot lid, is a closure that allows access to a storage or luggage compartment. Typically this storage compartment is separate from the cabin area of the vehicle, but that is not always the case. A hood, which may also be referred to as a bonnet, is a closure that allows access to an engine (or prime mover) compartment. A top is a form of vehicle closure that may open the cabin of a vehicle to the open-air, and the kinds of vehicles that have a top are generally referred to as convertibles.

Most vehicle closures require a means for securing the closure to the vehicle when the closure is in a closed position. A latch and striker combination may be used with a vehicle closure to releasably engage the latch on to the striker to secure the closure. Typically the latch is located on the closure and the striker is located on a vehicle part proximate to the opening the closure encloses when closed, although these components may be swapped. The striker typically extends away from the vehicle to which it is attached allowing the latch to engage and at least partially wrap around a portion of the striker to secure the closure.

The latch and striker combination establish the distance the closure is from a vehicle part proximate the closure when the closure is secured. The striker may be attached to the vehicle part. The vehicle part may be a body panel of fascia, or a body panel or fascia may be attached to the vehicle part to which the striker is attached with a portion extending toward the closure. The latch and striker combination establish the distance the closure is from the vehicle part, body panel, and/or fascia. Large distances between the closure and the vehicle may create an appearance issue for customers.

Decklid to bumper fascia distances may sometimes be larger than door to body panel distances. The decklid to bumper fascia distance may increase because of larger stack-up tolerances between the Decklid and Fascia as compared to other closures. Decklids may also need to set an over-travel distance in a generally vertical direction to accommodate for when the decklid is slammed down. This over-travel may be of the order of 2.0 mm and an improper decklid to fascia distance may lead to paint chipping due to contact when closing. Thus the minimum gap on most decklid to fascia in the vertical direction is on the order of 5-7 mm. The decklid margins to the tail-lamps and body may be equally critical and are a largely influenced by the result of the transverse attachment locations of the latch and striker to the decklid and vehicle part.

SUMMARY

One aspect of this disclosure is directed to a system for adjusting distance between a latched closure and a vehicle part. The system has a latch attached to the closure, and a striker assembly attached proximate the vehicle part. A striker is attached to the striker assembly that in combination with the latch releasably secures the closure, and a threaded connector operatively connected between the striker and the vehicle part for moving the striker relative the vehicle part. In this aspect the closure may be a decklid and the vehicle part may be a rear bumper fascia.

The striker assembly may further comprise a striker plate having the striker extending therefrom and a base plate slideably connected to the striker plate and attached to the vehicle. The striker assembly may also have a rivet disposed in a first rivet aperture of the striker plate and a second rivet aperture of the base plate. The second rivet aperture may have a dimension in the adjustment direction longer than the first rivet aperture. The rivet may sandwich the striker plate to the base plate.

According to another aspect of this disclosure an adjustable striker assembly for a vehicle closure is disclosed. In this aspect, a striker plate has a striker extending from the striker plate. The striker plate also defines a first aperture. A base plate is attachable proximate the vehicle closure. The base plate defines a second aperture. A threaded adjuster having an axis extending in an axial direction is disposed through the first and second apertures of the striker and base plates. Rotation of the threaded adjuster moves the striker plate, and the striker extending therefrom, relative to the base plate in the axial direction.

The striker plate may have a striker face with a first tab extending from the striker face. The tab may define the first aperture. The base plate may have a support face with a second tab extending from the support face. The second tab may define the second aperture. The first and second tabs may extend away from the striker and support faces in an orthogonal direction.

The assembly may also have a rivet that attaches the striker plate to the base plate. The base plate and striker plate may each define at least one rivet aperture with the rivet disposed therein. The rivet may sandwich the base and striker plates together. The rivet aperture defined by the base plate may be a slot. A length of the slot may extend in the axial direction. The rivet aperture defined by the base plate may be a rhombus shaped aperture.

The assembly may also have a second threaded adjuster. The striker plate may define a third aperture and the base plate may define a fourth aperture. The second threaded adjuster may have a second axis, and may be disposed in the third and fourth apertures. Rotation of the second threaded adjuster moves the striker relative to the base plate in the second axial direction. The second axial direction may be orthogonal to the axial direction.

The striker plate may have a striker face with a first tab extending from the striker face. The first tab may define the first aperture. The striker plate may also have a third tab extending from the striker face. The third tab may define the third aperture. The base plate may have a support face with a second tab extending from the support face. The second tab may define the second aperture. The base plate may also have a fourth tab extending from the support face. The fourth tab may define the fourth aperture. The first and second tabs may extend orthogonally away from the striker and support faces in the same direction. The third and the fourth tabs may extend away from the striker and support faces in the same direction. The axis of the threaded adjuster may be orthogonal to the second axis of the second threaded adjuster. The fourth aperture may be slot shaped extending in the axial direction.

According to a further aspect of this disclosure, a striker assembly for a vehicle closure is shown. In this aspect, a striker plate has a striker extending from the striker plate. The striker plate defines a first threaded aperture having a generally vertical axis. The striker plate also defines a second threaded aperture with a generally transverse axis. A first threaded connector is disposed in the first threaded aperture. A second threaded connector is disposed in the second threaded aperture. The threaded connectors connect the striker plate to a vehicle part. Rotating the threaded connectors moves the striker in the axial directions relative the vehicle part.

The striker assembly may have a base plate attached to the vehicle part proximate the vehicle closure. The base plate defines third and fourth non-threaded apertures having the first and second threaded connectors disposed therein. The connecting of the striker plate to the vehicle part by the first and second threaded connectors may be done through the base plate. The fourth non-threaded aperture may be a slot generally extending in a vertical direction.

The striker assembly may also have a rivet. The striker plate may define a first rivet aperture and the base plate may define a second rivet aperture. The rivet may be disposed within the first and second rivet apertures to sandwich the striker plate to the base plate.

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 1:
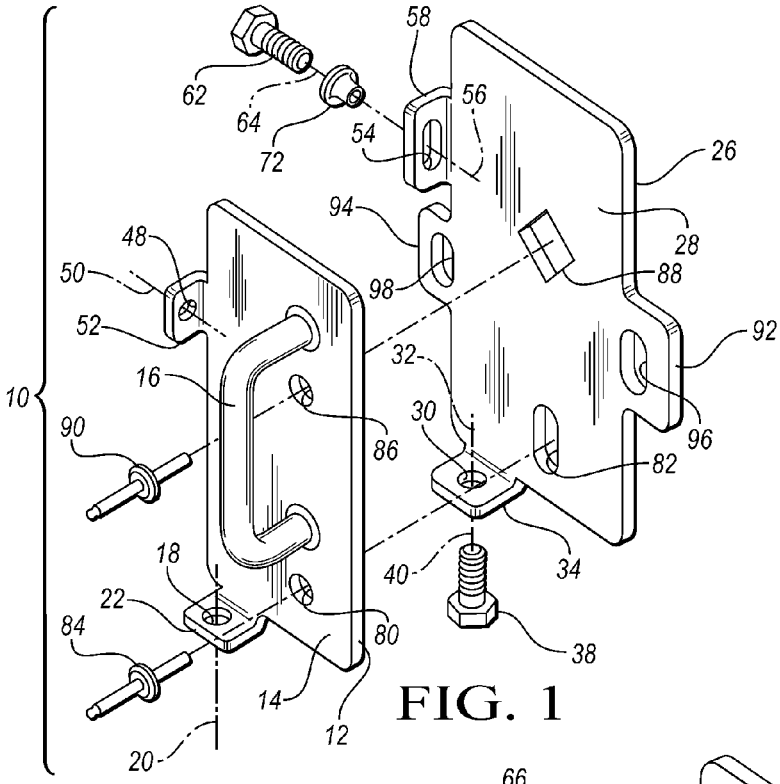
FIG. 1 is an exploded view of one embodiment of an adjustable striker assembly.
Figure 2:
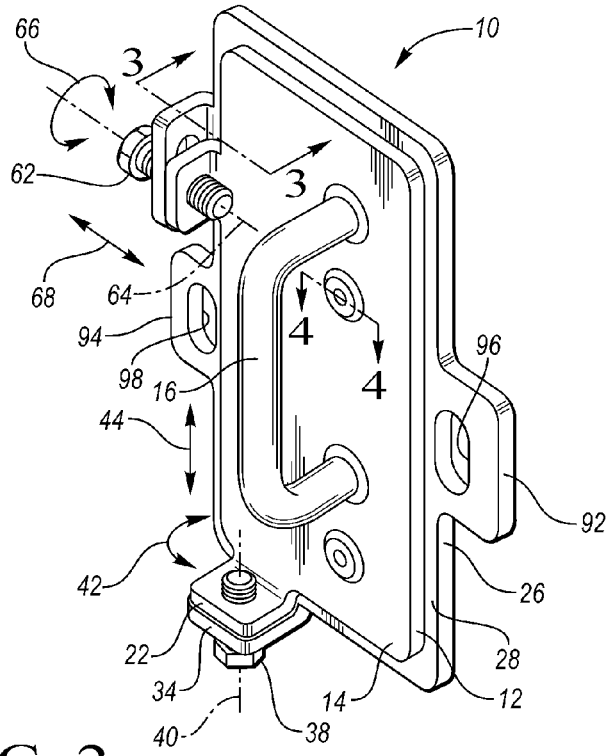
FIG. 2 is a perspective view of one embodiment of an adjustable striker assembly.

FIGS. 1 and 2 show a striker assembly 10, with FIG. 1 being an exploded view and FIG. 2 being an assembled view. Striker assembly 10 has a striker plate 12 with a striker face 14. The striker assembly 10 has a striker 16 attached to and extending from the striker plate 12. Although the striker 16 shown here is attached to the striker plate 12 in two locations, other common striker designs may be used, such as a post design that only attaches at a single location.

The striker plate 12 defines a first aperture 18. The first aperture 18 may be a threaded aperture 18 or non-threaded aperture 18. The first aperture 18 has a first axis 20 extending through the center point of the aperture 18. The first axis 20 may be referred to as a generally vertical axis 20. Generally, as used here, does not mean directly vertical in reference to gravitational pull, rather that the axis may be aligned such that a component of the direction may be in a vertical direction relative to a vehicle.

The striker plate 12 has a first tab 22 that defines the first aperture 18. The first tab 22 may extend from the striker face 14, and may extend generally orthogonally away from the striker face 14. Generally, as used here, does not mean that the striker face 14 and first tab 22 are at exact right angles to one another, rather it means that they are more at right angles than not.

A base plate 26 may be slideably connected to the striker plate 12. The base plate 26 has a support face 28 that may contact the striker plate 12. The base plate 26 defines a second aperture 30. The second aperture 30 may be a threaded aperture 30 or non-threaded aperture 30. The second aperture 30 has a second axis 32 extending through the center point of the aperture 30. The second axis 30 may also be referred to as a generally vertical axis 30.

The base plate 26 has a second tab 34 that defines the second aperture 30. The second tab 34 may extend from the support face 28, and may extend generally orthogonally away from the support face 28. The second tab 34 may extend in the same direction as the first tab 22, and the striker plate 12 and base plate 26 aligned such that the first and second axis 20, 32 may be coaxial when assembled.

A threaded connector 38, or threaded adjuster 38, may operatively connect the striker plate 12 to the base plate 26. The threaded connector 38 may have a connector axis 40 that extends down the center of the connector. The threaded connector 38 may be disposed in and extend through the first and second apertures 18, 30, and the connector axis 40 may be substantially coaxial with the first and second axis 20, 32.

Rotation of the threaded connector 38, as shown by arrow 42, moves the striker plate 12 relative to the base plate 26 in the axial direction 40, as shown by arrow 44 in FIG. 2. This may be accomplished by one or both of the first and second apertures 18, 30 being threaded. Movement of the striker plate 12 relative to the base plate 26 may allow for the striker 16 to be adjusted in a generally vertical direction after the striker assembly 10 has been installed in a vehicle. The threaded connector 38 may also utilize one or more locking nuts, not shown, to set an adjustment position.

The striker assembly 10 is also shown having the striker plate 12 defining a third aperture 48, although a third aperture 48 is not a necessary component of the striker assembly 10.

The third aperture 48 may be a threaded aperture 48 or non-threaded aperture 48. The third aperture 48 has a third axis 50 extending through the center point of the aperture 18. The third axis 50 may be referred to as a generally transverse axis 50. Generally transverse, as used here, means that the axis 50 may be aligned such that a component of the direction may extend in a cross direction to the axial directions 20, 32 as described with the first and second apertures 18, 30.

The striker plate 12 is shown having a third tab 52 that defines the third aperture 48. The third tab 52 may extend from the striker face 14, and may extend generally orthogonally away from the striker face 14. Generally, as used here, does not mean that the striker face 14 and third tab 52 are at exact right angles to one another, rather it means that they are more at right angles than not.

The base plate 26 is shown defining a fourth aperture 54, although a fourth aperture 54 is not a necessary component of the striker assembly 10. The fourth aperture 54 may be a threaded aperture 54 or non-threaded aperture 54. The fourth aperture 54 may be slot shaped. The length of the slot may extend in a direction substantially parallel with the axial directions 20, 32 as described with the first and second apertures 18, 30. The fourth aperture 54 has a fourth axis 56 extending through the center point of the aperture 54.

The base plate 26 is shown having a fourth tab 58 that defines the fourth aperture 54. The fourth tab 58 may extend from the support face 28, and may extend generally orthogonally away from the support face 28. The fourth tab 58 may extend in the same direction as the third tab 52, and the striker plate 12 and base plate 26 may be aligned such that the third and fourth axis 50, 56 may be coaxial when assembled.

A second threaded connector 62, or threaded adjuster 62, may operatively connect the striker plate 12 to the base plate 26. Like the third and fourth apertures 48,54, a second threaded connector 62 is not a necessary component of the striker assembly 10. Numbering of the components, such as the apertures, tabs, and connectors, is not meant to be limiting and does not describe any specific order of the components, rather the numbering of the components is to merely separate the components from each other as being separate and distinct. As such, any reference to a second component, when part of the assembly, is distinct and different from the component as listed before, even if the component listed before had no numbering. For example, the above threaded connector 38, may be referred to as a first threaded connector 38 when used in conjunction with the second threaded connector 62.

The threaded connector 62 may have a second connector axis 64 that extends down the center of the connector. The threaded connector 62 may be disposed in and extend through the third and fourth apertures 48, 54, and the second connector axis 64 may be substantially coaxial with the third and fourth axis 50, 56. The second connector axis 64 may be substantially orthogonal to the first connector axis 40.

Rotation of the second threaded connector 62, as shown by arrow 66, moves the striker plate 12 relative to the base plate 26 in the axial direction 64, as shown by arrow 68 in FIG. 2. This may be accomplished by one or both of the third and fourth apertures 48, 54 being threaded. Movement of the striker plate 12 relative to the base plate 26, by the second threaded connector 62, may allow for the striker 16 to be adjusted in a transverse direction after the striker assembly 10 has been installed in a vehicle. The threaded connector 62 may also utilize one or more locking nuts, not shown, to set an adjustment position.

To account for the generally vertical movement of the striker plate 12 relative to the base plate 26 that may occur by the rotation of threaded connector 38, one of the third and fourth apertures 48, 54 may be slotted, with the length of the slot extending substantially parallel to the axial direction of the first threaded connector 38. A slip washer 72 may be inserted into the slot and allow for the threaded connector 62 to slide within the slot when the striker plate 12 moves relative to the base plate 26.

Figure 3:
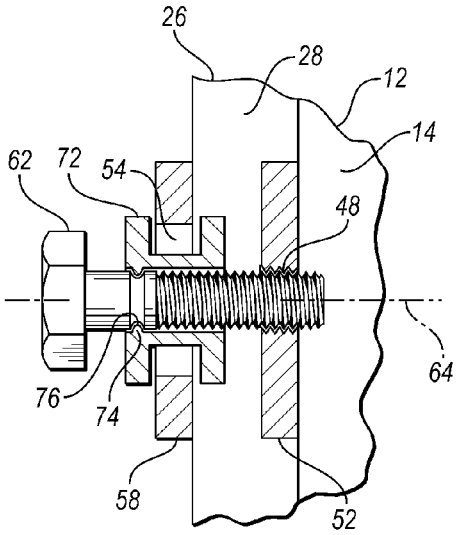
FIG. 3 is a cross-sectional view taken along line 3-3 in FIG. 2 showing a second threaded adjuster disposed in a slotted aperture on the base plate.

FIG. 3 shows a cross sectional view of the third and fourth tabs 58, 52. In this example, the third aperture 48 is threaded while the fourth aperture 54 is non-threaded and slotted, although these configurations could be swapped. The slip washer 72 is crimped on both sides of the slot 54 and has a protrusion 74 which engages a depression 76 defined by the threaded connector 62, the protrusion and depression 74, 76 cooperate to maintain the threaded connector 62 stationary relative to movement along axis 64, such that as the threaded connector 62 moves the fourth tab 58 closer to or further away from the third tab 52. Although not shown as such, the first and second tabs 22, 34 may also have a similar configuration. As shown, the first and second tabs 22, 34 may elastically deform from movement of the plates 12, 26 due to rotation of the threaded connector 62.

Figure 4:
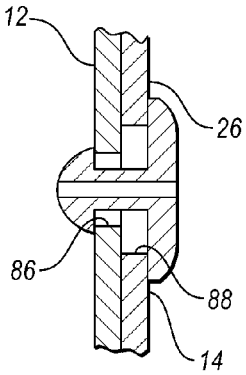
FIG. 4 is a cross-sectional view taken along line 4-4 in FIG. 2 showing a rivet sandwiching a striker plate with a base plate.

The striker plate 12 may define a first rivet aperture 80, the base plate 26 may define a second rivet aperture 82, and a rivet 84 may be disposed within the first and second rivet apertures 80, 82 sandwiching the striker plate 12 to the base plate 26. One of the first and second rivet apertures 80, 82 may be larger than the other, allowing for sliding movement between the striker and base plates 12, 26. The striker plate 12 may define a third rivet aperture 86, the base plate 26 may define a corresponding fourth rivet aperture 88, and a second rivet 90 may be disposed therein. One of the third and fourth rivet apertures 86, 88 may be larger than the other, as shown in FIG. 4, allowing for sliding movement between the striker and base plates 12, 26.

In the case of only one threaded adjuster 38, 62 being used, one of the two corresponding apertures 80, 82 or 86, 88 may be slot shaped in a direction substantially parallel to the axial direction of the threaded adjuster 38. In the case of one or more threaded adjusters 38, 62 being used, one of the two corresponding apertures 80, 82 or 86, 88 may be rhombus shaped, as shown in FIG. 1 with rivet aperture 88, to allow for movement in both directions.

Figure 5:
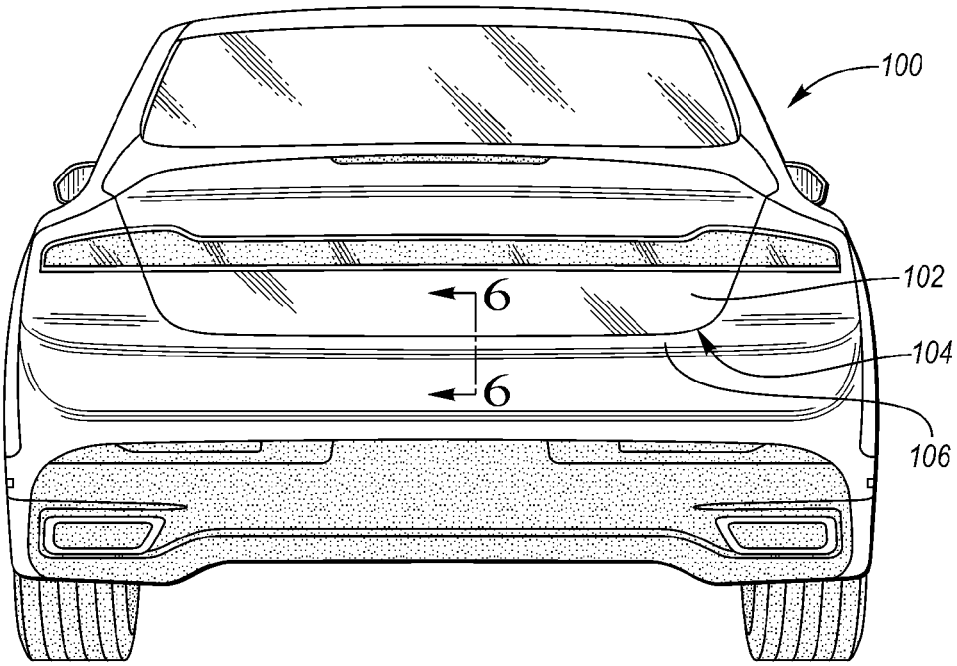
FIG. 5 is a rear view of a vehicle showing a decklid and bumper fascia.
Figure 6:
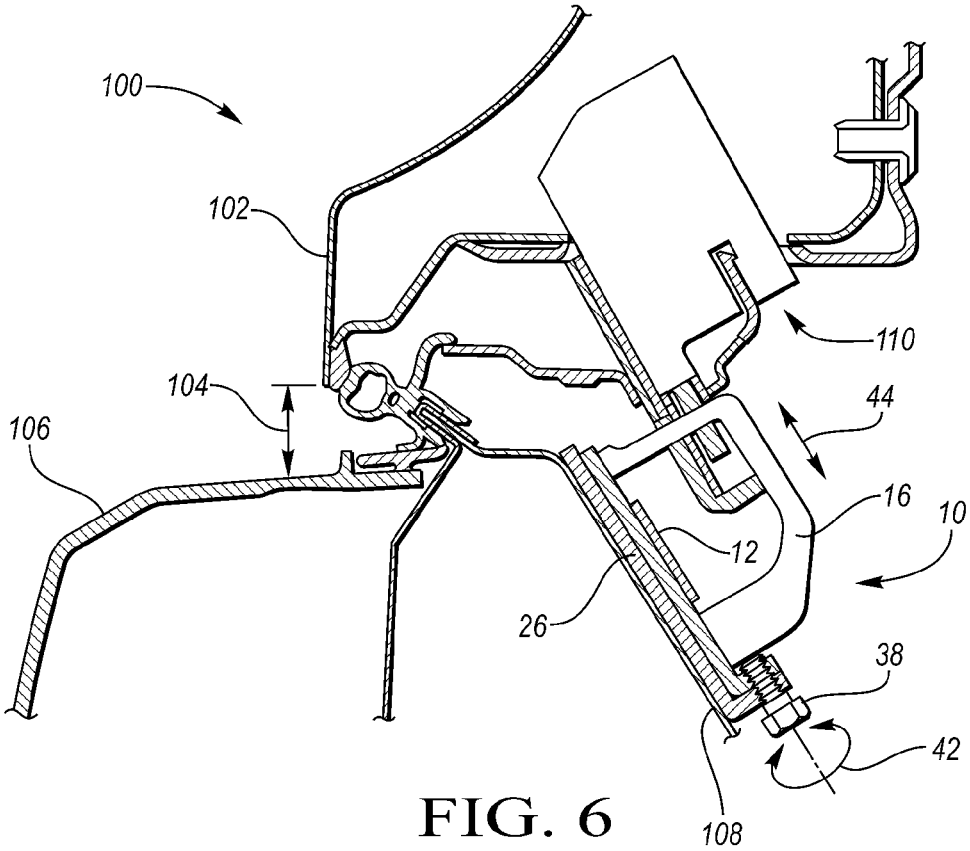
FIG. 6 is the cross-sectional view taken along line 6-6 in FIG. 5 showing an adjustable striker assembly disposed between a latched closure and a vehicle part.

The base plate 26 may also include additional attachment locations 92, 94 to allow the base plate 26 to be attachable to a vehicle 100 (see FIGS. 5 and 6). The attachment locations 92, 94 may define be attachment apertures 96, 98 in which an attachment bolt may pass through to attach the striker assembly 10 to the vehicle 100. The attachment locations 92, 94 may be on the support face 28, or they may extend away from the support face 28 such as to not interfere with the striker plate 12 being supported by the base plate 26, or any adjustment movement between the two.

FIG. 5 shows the rear of a vehicle 100. Vehicle 100 has a closure 102 in a close position. Closure 102 in this figure is a decklid 102. The closure 102, when closed, defines a gap 104 between it and an adjacent vehicle part 106. The vehicle part 106 in this figure is a bumper fascia 106. The striker assembly 10 may be attached to the vehicle part 106 or to a second vehicle part 108 adjacent to vehicle part 106 (see FIG. 6).

FIG. 6 shows a striker assembly 10 attached to a vehicle part 108. The striker 16 in combination with a latch 110 releasably secures the closure 102 on the vehicle 100. The base plate 26 is shown here attached to the vehicle 100 proximate the vehicle closure 102. The base plate 26 is attached to second vehicle part 108. The second vehicle part 108 is proximate the bumper fascia 106. The closure 102 and bumper fascia 106 cooperate to define the gap 104. Rotation of threaded connector 38, as shown by arrow 42, moves the striker 16 in a generally vertical direction relative to the vehicle 100. Movement of the striker 16 changes the margin of gap 104. Threaded connector 38 would allow for the distance between a decklid 102 and bumper fascia 106 to be adjusted after the striker 16 is attached to the vehicle 100.

An alternative design allows for a vehicle part 108 to function as the base plate 26 providing at least one threaded connector aperture and/or rivet aperture (not shown). The threaded connector 38 may operatively connect the striker 16 directly to the vehicle part 108 for moving the striker 16 relative the vehicle part 108. Similar to above, the vehicle part 108 may define at least a second threaded connector aperture (not shown) to provide for transverse adjustment of the striker 16.

While exemplary embodiments are described above, it is not intended that these embodiments describe all possible forms of the disclosed apparatus and method. Rather, the words used in the specification are words of description rather than limitation, and it is understood that various changes may be made without departing from the spirit and scope of the disclosure as claimed. The features of various implementing embodiments may be combined to form further embodiments of the disclosed concepts.

What is claimed is:

1. A system for adjusting distance between a latched closure and a vehicle part comprising:

a latch attached to the closure;

a striker assembly including a striker plate having a first rivet aperture, and a striker that cooperates with the latch to releasably secure the closure;

a base plate attached to the vehicle part and including a second rivet aperture, wherein the striker plate is slideably connected to the base plate, wherein one of the first and second rivet apertures has a dimension in an adjustment direction longer than the other of the first and second rivet apertures;

a rivet disposed within the first and second rivet apertures and sandwiching the striker plate to the base plate such that the striker plate is slidable relative to the base plate; and a threaded connector operatively connected between the striker and the base plate for moving the striker relative the base plate.

2. The system of claim 1 wherein the closure is a decklid and the vehicle part is a rear bumper fascia.

3. An adjustable striker assembly for a vehicle closure comprising:

a striker plate having a striker extending therefrom and defining first and second apertures;

a base plate attachable proximate the vehicle closure and defining third and fourth apertures;

a first threaded adjuster disposed in the first and third apertures and having an axis extending in a first axial direction, wherein rotation of the first threaded adjuster moves the striker relative to the base plate in the first axial direction; and a second threaded adjuster disposed in the second and fourth apertures and having an axis extending in a second axial direction, wherein rotation of the second threaded adjuster moves the striker relative to the base plate in the second axial direction.

4. The assembly of claim 3 wherein the striker plate has a striker face with a first tab extending from the striker face defining the first aperture and the base plate has a support face with a second tab extending from the support face defining the third aperture.

5. The assembly of claim 4 wherein the first and second tabs extend generally orthogonally away from the striker and support faces, respectively.

6. The assembly of claim 3 wherein the second axial direction is substantially orthogonal to the first axial direction.

7. The assembly of claim 3 wherein the striker plate has a striker face with a first tab extending therefrom defining the first aperture and a third tab extending therefrom defining the second aperture, the base plate has a support face with a second tab extending therefrom defining the third aperture and a fourth tab extending therefrom defining the fourth aperture.

8. The assembly of claim 7 wherein the first and second tabs extend generally orthogonally away from the striker and support faces in a same direction, and the third and the fourth tabs extend away from the striker and support faces in a same direction, and the first axis of the first threaded adjuster is generally orthogonal to the second axis of the second threaded adjuster.

9. The assembly of claim 3 wherein the fourth aperture is slot shaped extending in the first axial direction.

10. An adjustable striker assembly for a vehicle closure comprising:

a striker plate having a striker extending therefrom and defining a first aperture;

a base plate attachable proximate the vehicle closure defining a second aperture;

a rivet that slidably attaches the striker plate to the base plate, wherein both the base plate and striker plate each define at least one rivet aperture with the rivet disposed therethrough; and a threaded adjuster having an axis extending in an axial direction and through the first and second apertures, wherein rotation of the threaded adjuster moves the striker relative to the base plate in the axial direction.

11. The assembly of claim 10 wherein at least one of the rivet apertures is a slot.

12. The assembly of claim 11 wherein a length of the slot extends in the axial direction.

13. The assembly of claim 10 wherein the at least one of the rivet apertures is a rhombus shaped aperture.

14. A striker assembly comprising:

a base plate defining two holes;

a striker plate having a striker and defining a first threaded aperture with a vertical axis and a second threaded aperture with an axis transverse to the vertical axis; and first and second fasteners disposed in the threaded apertures and holes, respectively, and connecting the striker plate to the base plate such that rotation of the fasteners moves the striker relative to the base plate.

15. The striker assembly of claim 14 wherein one of the two holes is a slot generally extending in a vertical direction.

16. The striker assembly of claim 14 further comprising a rivet, wherein the striker plate further defines a first rivet aperture and the base plate further defines a second rivet aperture, and the rivet is disposed within the first and second rivet apertures to sandwich the striker plate to the base plate.

* * * * *